US011799181B2

(12) United States Patent
Li et al.

(10) Patent No.: US 11,799,181 B2
(45) Date of Patent: Oct. 24, 2023

(54) CROSS-COUPLED FILTER

(71) Applicants: PROSE TECHNOLOGIES (SUZHOU) CO., LTD., Suzhou (CN); PROSE TECHNOLOGIES LLC, Mount Olive, NJ (US)

(72) Inventors: Dunrong Li, Suzhou (CN); Renhu Luo, Suzhou (CN); Ze Yin, Suzhou (CN); Qiang Li, Suzhou (CN)

(73) Assignees: PROSE TECHNOLOGIES (SUZHOU) CO., LTD, Suzhou (CN); PROSE TECHNOLOGIES LLC, Mount Olive, NJ (US)

( * ) Notice: Subject to any disclaimer, the term of this patent is extended or adjusted under 35 U.S.C. 154(b) by 108 days.

(21) Appl. No.: 17/523,449

(22) Filed: Nov. 10, 2021

(65) Prior Publication Data

US 2022/0069427 A1 Mar. 3, 2022

Related U.S. Application Data

(63) Continuation of application No. PCT/CN2019/086796, filed on May 14, 2019.

(51) Int. Cl.
*H01P 1/208* (2006.01)

(52) U.S. Cl.
CPC ..... *H01P 1/2086* (2013.01); *H01P 1/208* (2013.01)

(58) Field of Classification Search
CPC ..... H01P 1/2002; H01P 1/201; H01P 1/20; H01P 1/202; H01P 1/203; H01P 1/20327;
(Continued)

(56) References Cited

U.S. PATENT DOCUMENTS 4,216,448 A 8/1980 Kasuga et al.
5,410,284 A 4/1995 Jachowski
(Continued)

FOREIGN PATENT DOCUMENTS

CN 1652392 A 8/2005
CN 103166593 A 6/2013
(Continued)

OTHER PUBLICATIONS

World Intellectual Property Organization (WIPO) International Search Report for PCT/CN2019/086796 dated Feb. 17, 2020 6 pages (with translation).

*Primary Examiner* — Stephen E. Jones
(74) *Attorney, Agent, or Firm* — ANOVA LAW GROUP, PLLC

(57) ABSTRACT

A cross-coupled filter includes a resonant structure including a plurality of columns of resonant units, each column of resonant units includes at least two resonators. A dominant coupling mode of a coupling between two adjacent resonators in a same column is electrical coupling or magnetic coupling. Dominant coupling modes of a plurality of groups of two adjacent resonators in the same column alternate between electrical coupling and magnetic coupling. A dominant coupling mode of a coupling between two adjacent resonators in adjacent columns is electrical coupling or magnetic coupling. Dominant coupling modes of a plurality of groups of two resonators of two adjacent columns alternate between electrical coupling and magnetic coupling, to form at least a set of cross-coupling. The present disclosure realizes miniaturization and light weight in structural characteristics, and realizes low loss and good harmonic characteristics in electrical performance.

11 Claims, 13 Drawing Sheets

(58) Field of Classification Search
CPC .. H01P 1/20336; H01P 1/20354; H01P 1/205; H01P 1/2053; H01P 1/207; H01P 1/208; H01P 1/2082; H01P 1/2084; H01P 1/2086; H01P 1/2088
See application file for complete search history.

(56) References Cited

U.S. PATENT DOCUMENTS

| | | | | |
|---|---|---|---|---|
| 11,437,691 | B2 * | 9/2022 | Jing | H01P 3/16 |
| 2012/0229233 | A1 * | 9/2012 | Ito | H01P 1/2088 333/212 |
| 2021/0091441 | A1 * | 3/2021 | Nakahori | H01P 1/2002 |

FOREIGN PATENT DOCUMENTS

| | | | |
|---|---|---|---|
| CN | 107196023 | A | 9/2017 |
| CN | 107732390 | A | 2/2018 |
| CN | 108539337 | A | 9/2018 |
| CN | 1111446524 | A | 7/2020 |

* cited by examiner

CROSS-COUPLED FILTER

CROSS-REFERENCE TO RELATED APPLICATION

This application is a continuation application of PCT application PCT/CN2019/086796, filed on May 14, 2019, the entire content of which is incorporated herein by reference.

TECHNICAL FIELD

The present disclosure relates to the technical field of a filter, and more particularly, to a cross-coupled filter.

BACKGROUND

Recently there is a demand for and a trend towards miniaturization and high-quality requirements of a filter. In particular, the communication components used in small base stations for 5G communications are smaller in size and more in demand than previous macro base station products. Therefore, the components used in the products must also be high-quality, miniaturized, lightweight, and have a structure suitable for mass production.

Currently, the filter used in small base stations is usually a dielectric waveguide filter or a traditional metal coaxial filter. The dielectric waveguide filter can be miniaturized and lightweight, and has a low manufacturing cost, but has worse loss and harmonic characteristics compared to the metal coaxial filter. The traditional metal coaxial filter has better loss and harmonic characteristics compared to the dielectric waveguide filter, but the reduction in size and weight of the design characteristics has reached a certain limit, and the number of internal components has also reached the limit, which cannot achieve the purpose of reducing manufacturing cost.

Therefore, it is necessary to propose a new type of miniaturized and light-weight filter to solve issues such as the degradation of the insertion loss and the degree of suppression of the electrical performance, the possibility of deformation during die-casting, the need for double frequency harmonic improvement and other issues.

SUMMARY

The purpose of the present disclosure is to overcome the defects of the prior art and provide a cross-coupled filter.

One aspect of the present disclosure provides a cross-coupled filter including a resonant structure. The resonant structure includes a plurality of columns of resonant units, each column of resonant units including at least two resonators. A dominant coupling mode of a coupling between two adjacent resonators in a same column is electrical coupling or magnetic coupling, and dominant coupling modes of a plurality of groups of two adjacent resonators in the same column alternate between electrical coupling and magnetic coupling. A dominant coupling mode of a coupling between two adjacent resonators in adjacent columns is electrical coupling or magnetic coupling; and dominant coupling modes of a plurality of groups of two resonators of two adjacent columns alternate between electrical coupling and magnetic coupling, to form at least a set of cross-coupling.

The beneficial effects of the present disclosure are listed below:

1. the advantages of dielectric waveguide filters and metal coaxial filters are integrated as much as possible to achieve miniaturization and light weight in terms of structural characteristics, and achieve low loss and good harmonic characteristics in terms of electrical performance. In addition, the number of components inside the filter is minimized as much as possible, which reduces the production cost and simplifies the production process to be suitable for mass production.

2. the resonant structure of the filter adopts an integrated frame structure, which is easy to assemble and has good assembling tolerance consistency, such that the product quality of the filter can be maintained stably.

3. adjusting the coupling amount on the cover and improving the shielding structure for harmonics can reduce the size of the resonator, realize the miniaturization of the filter, improve the Q value of the resonator, and reduce loss.

REFERENCE NUMERALS

1. resonant structure, 11. frame, 12. resonator, 121. resonant head, 122. resonant middle portion, 123. resonant tail, 124. tuning hole, 2. top cover, 3. bottom cover, 4. signal input port, 5. signal output port, 6. partition wall, S1. transmission loss waveform, S2. return loss waveform.

DETAILED DESCRIPTION OF THE EMBODIMENTS

The technical solutions of the embodiments of the present disclosure will be clearly and completely described below in conjunction with the accompanying drawings of the present disclosure.

Figure 1:
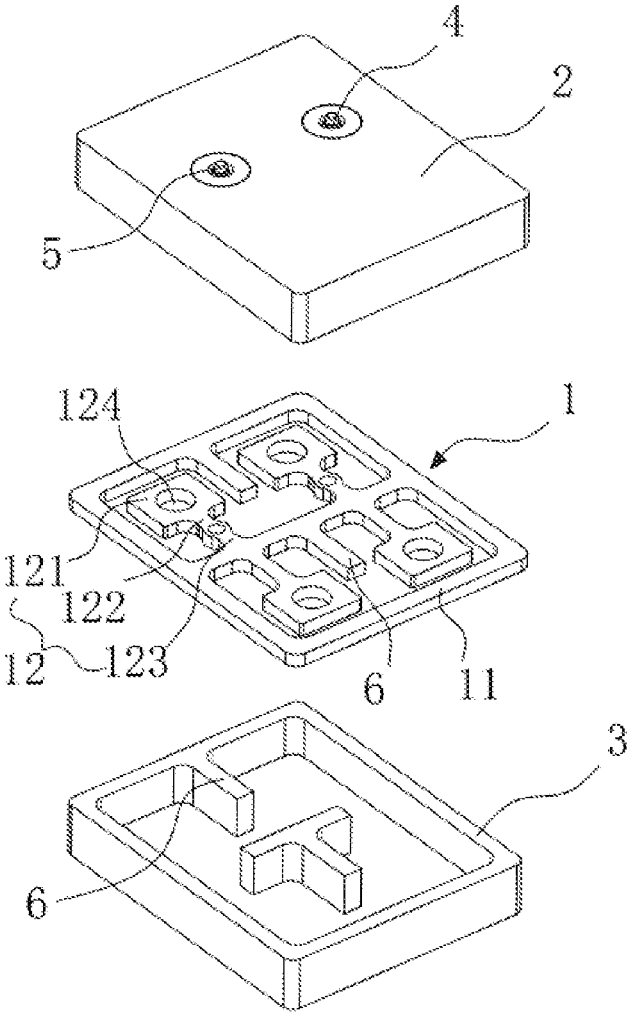
FIG. 1 is an exploded view of a cross-coupled filter according to Embodiment 1 of the present disclosure.

As shown in FIG. 1, a cross-coupled filter disclosed in the present disclosure includes a resonant structure 1, a top cover 2, a bottom cover 3, a signal input port 4, and a signal output port 5. The resonant structure 1 can be formed integrally using an integrated framework. The resonant structure 1 includes a frame 11 and a plurality of columns of resonant units, each column of resonant units includes at least two resonators 12. Compared with the existing resonant structure with a divided layout, the frame-integrated resonant structure 1 has the advantages of simple assembly, good assembly tolerance consistency, and stable product quality, which is suitable for mass production.

In some embodiments, as an alternative, the resonant structure 1 can be detachably installed to a top cover 2 and/or a bottom cover 3 through a fixing structure (such as screws, not shown), and includes a plurality of columns of resonant units. That is, the resonant structure 1 does not include the frame 11. During implementation, the resonant structure 1 and the top cover 2 or the bottom cover 3 are provided with fixing holes (not shown in the figures), and the screws pass through the corresponding fixing holes to fix the resonant structure 1 to the top cover 2 or the bottom cover 3.

The plurality of columns of resonant units extend in the frame 11 along one side wall of the frame 11 to the other side wall opposite to the one side wall, for example, along the front and back directions where the front and back side walls of the frame 11 are located, or along the left and right directions where the left and right side walls of the frame 11 are located. The plurality of columns of resonant units are located on the same plane.

The shape design of resonators 12 and arrangement of the resonators 12 in the frame 11 determine the coupling mode(s) between the resonators 12. In this embodiment, as shown in FIG. 1, each resonator 12 has an overall cylindrical appearance, and includes a resonant head 121, a resonant middle portion 122, and a resonant tail 123. The resonant head 121 is the portion of the resonator 12 having the strongest electrical coupling when its dominant coupling mode is electrical coupling. On the contrary, the resonant tail 123 is the portion of the resonator 12 having the strongest magnetic coupling when its dominant coupling mode is magnetic coupling. In some embodiments, the width of the resonant head 121 is wider than the widths of the resonant middle portion 122 and the resonant tail 123, so that the size of the resonator 12 can be further reduced under the requirement of the same frequency. In addition, the resonant head 121 is provided with a tuning hole 124 penetrating through the upper and lower end surfaces of the resonant head 121 for adjusting the resonant frequency of the resonator 12. In some embodiments, the resonator structure with a plurality of bendings is also applicable to the present disclosure.

The plurality of columns of resonators 12 are arranged in the frame 11 along a signal transmission path, the signal transmission path may be U-shaped or S-shaped, or a curved path formed by a plurality of continuous U-shapes or S-shapes. The coupling mode of two adjacent resonators 12 on the signal transmission path is determined by their shapes and mutual arrangement positions. It should be noted that the coupling of a general TEM (transverse electromagnetic mode) filter is a coexistence of electrical coupling and magnetic coupling, one of these two types of coupling with a larger coupling amount is called the dominant coupling. The dominant coupling mode in the filter of the present disclosure can be determined by the arrangement position of the two coupled resonators. If the coupling between the two coupled resonators is dominantly generated by the resonant heads, the dominant coupling mode is electrical coupling, and the coupling can be referred to as dominant electrical coupling. If the coupling between the two coupled resonators is dominantly generated by the resonant tail, the dominant coupling mode is magnetic coupling, and the coupling can be referred to as dominant magnetic coupling. If the difference between the amount of the electrical coupling between the two coupled resonators and the amount of the magnetic coupling between the two coupled resonators is slight, the coupling between the two coupled resonators is electromagnetic hybrid coupling.

In this embodiment, on the signal transmission path, two adjacent resonators 12 in the same column are dominantly electrically coupled or magnetically coupled, that is, the coupling amount of two adjacent resonators 12 is dominantly determined by the resonant head 121 or resonant tail 123, specifically, two resonant heads 121 of two adjacent resonators 12 in the same column are arranged to face each other to form a dominant electrical coupling, or two resonant tails 123 are connected to form a dominant magnetic coupling. In some embodiments, the arrangement of the resonators 12 in the same column is not limited to the above introduced here, as long as it can be realized that two adjacent resonators 12 can form an arrangement structure with a dominant electrical coupling or a dominant magnetic coupling, the solution is within the protection scope of the present disclosure.

And the resonators 12 in the same column form a group of adjacent resonators 12 or a plurality of groups of adjacent resonators 12, wherein when a group of adjacent resonators 12 are formed (that is, there are two resonators 12 in a column), in this group of the resonators 12, that is, the resonant heads 121 are arranged to face each other to form a dominant electrical coupling, or the resonant tails 123 are connected to form a dominant magnetic coupling.

When a plurality of groups of adjacent resonators 12 are formed (that is, there are no less than three resonators 12 in a same column), these plurality of groups of adjacent resonators 12 are electrically coupled and magnetically coupled in an alternating form, or magnetically coupled and electrically coupled in an alternating form. In other words, dominant coupling modes of the plurality of groups of two adjacent resonators in the same column alternate between electrical coupling and magnetic coupling. Alternating between electrical coupling and magnetic coupling, as used herein, is the same as alternating between magnetic coupling and electrical coupling. For example, assuming resonators aa, bb, cc, dd are sequentially located in the same column, the dominant coupling modes of the plurality of groups of two adjacent resonators in the same column alternating between electrical coupling and magnetic coupling means that the dominant coupling modes of resonant groups (aa, bb), (bb, cc) and (cc, dd) have two possibilities: 1) electrical coupling, magnetic coupling, and electrical coupling; and 2) magnetic coupling, electrical coupling, and magnetic coupling. Specifically, the plurality of groups of adjacent resonators 12 in the same column are distributed by face-to-face resonant heads 121 and connected resonant tails 123 in an alternating form. In other words, distributed positions of the plurality of groups of adjacent resonators in the same column alternate between face-to-face of the resonant heads and connection of the resonant tails. For example, assuming resonators aa, bb, cc are sequentially located in the same column, the first group of adjacent resonators 12 (aa, bb) is distributed by arranging the resonant heads 121 to face each other, and the second group of adjacent resonators 12 (bb, cc) is distributed by connecting the resonant tails 123. In another example, the plurality of groups of adjacent resonators 12 in the same column are distributed by connecting the resonant tails 123 first for resonators (aa, bb) and arranging the resonant heads 121 to face each other next for resonators (bb, cc), and continue such alternating form.

Two adjacent resonators 12 in two adjacent columns are dominantly electrically coupled or magnetically coupled. In this embodiment, the positions of two adjacent resonators 12 in two adjacent columns are arranged correspondingly. Specifically, the two adjacent resonators 12 in two adjacent columns are arranged in parallel or approximately parallel, and the orientations of the resonant heads 121 or the resonant tails 123 of the two resonators 12 are the same, for example, if the two resonant heads 121 both face forward or backward, and the positions of the two resonant heads 121 are corresponding to each other, then the positions of the two resonant tails 123 are also corresponding to each other.

At least one partition wall is disposed between the resonant units of two adjacent columns, and these partition walls make the coupling formed between the two adjacent resonators of the resonant units in the two adjacent columns dominantly electrical coupling or magnetic coupling. In other words, the partition wall is configured to adjust the dominant coupling mode between two adjacent resonators of two adjacent columns. The position of the partition wall between the two resonators which can realize that the two resonators are dominantly electrically coupled or magnetically coupled is not limited in the present disclosure. When implemented, the partition wall can be arranged on the frame, and/or on the cover.

In addition, the plurality of groups of adjacent resonators 12 in two adjacent columns are dominantly electrically coupled and magnetically coupled in the alternating form. Alternatively, the plurality of groups of adjacent resonators 12 in two adjacent columns are dominantly magnetically coupled and electrically coupled in the alternating form. That is, when the coupling mode of a first group of adjacent resonators 12 in different columns is dominantly electrical coupling, then the coupling mode of a second group or two second groups of resonators 12 that are adjacent to the resonators 12 of the first group is dominantly magnetic coupling, and vice versa. In other words, dominant coupling modes of a plurality of groups of two adjacent resonators of two adjacent columns alternate between electrical coupling and magnetic coupling. For example, assuming resonators aa, bb, cc are sequentially located in the same first column and resonators dd, ee, ff are sequentially located in the same second column, the second column being adjacent to the first column, the dominant coupling modes of a plurality of groups of two adjacent resonators 12 of two adjacent columns alternating between electrical coupling and magnetic coupling means that the dominant coupling modes of resonant groups (aa, dd), (bb, ee) and (cc, ff) have two possibilities: 1) electrical coupling, magnetic coupling, and electrical coupling; and 2) magnetic coupling, electrical coupling, and magnetic coupling. In addition, at least one set of cross-coupling is formed in the plurality of groups of adjacent resonators 12 in two adjacent columns, the cross-coupling generates transmission zero points around both sides of the bandwidth respectively, and according to the number of resonators 12, the number of cross-couplings can be increased to increase the number of zero points. The realization of cross-coupling between the resonators 12 of the present disclosure does not require additional structural components, but according to conditions, additional structural components (such as metal rods, insulators, etc., not shown in figures) can be added between two adjacent resonators 12 that form cross-coupling to further increase the amount of cross-coupling.

The top cover 2 and the bottom cover 3 are respectively covered on the upper end surface and the lower end surface of the resonant structure 1 to form a closed filter cavity. In order to adjust the amount of coupling between the resonators on the resonant structure, etc., the cover (the top cover and/or the bottom cover) can be provided with a plurality of protrusions (not shown), at least a shielding post (not shown), and at least a connecting post (not shown), wherein the protrusion extends from an end face of the cover close to the resonant structure toward the resonant structure, and the arranged position of the protrusion on the cover is corresponding to the position of the resonant head 121 of the resonator 12 on the resonant structure, which can reduce the distance between the cover and the resonant head 121 of the resonator 12 as the closer to the resonator 12, the larger the distributed capacitance, which reduces the resonant frequency and shortens the length of the resonator, so as to realize the miniaturization of the filter, improve the Q value of the resonator, and reduce the loss.

The shielding post is disposed between two adjacent resonators 12 to adjust the coupling strength between the two resonators 12, and the shielding post forms the above-mentioned partition wall in the cover. Although the coupling strength between the resonators 12 can be adjusted by the spacing between the resonators 12, this way may increase the size of the filter, and on the basis of adjusting the coupling strength between the resonators 12, the shielding post does not affect the filter size.

The connecting post is disposed between two adjacent resonators 12 in the same column, and connects the top cover 2 and the bottom cover 3. The arrangement of the connecting post can improve the harmonic characteristics of the filter. When implemented, the connecting post is arranged on the top cover or the bottom cover.

In addition, a plurality of tuning screws (not shown) passing through the top cover 2 and extending into the tuning hole 124 of the resonator can be arranged on the top cover 2 to adjust the resonant frequency of the resonator 12. Further, a coupling adjustable screw (not shown) passing through the top cover 2 and extending between two adjacent resonators 12 can be arranged to adjust the coupling amount between the resonators 12.

In addition, after one of the top cover and the bottom cover is equipped with a resonator, the structure of the other of the top cover and the bottom cover can be simplified, such as reducing the thickness, and not providing the above-mentioned protrusions, partition walls, connecting posts, etc., which can reduce the overall thickness and size of the filter.

The signal input port 4 and the signal output port 5 are respectively arranged at the two ends of the above-mentioned signal transmission path, according to the different signal transmission paths, the positions thereof can also be arranged differently.

Several embodiments are used to introduce the specific structure of a cross-coupled filter of the present disclosure below.

Embodiment 1

Figure 2:
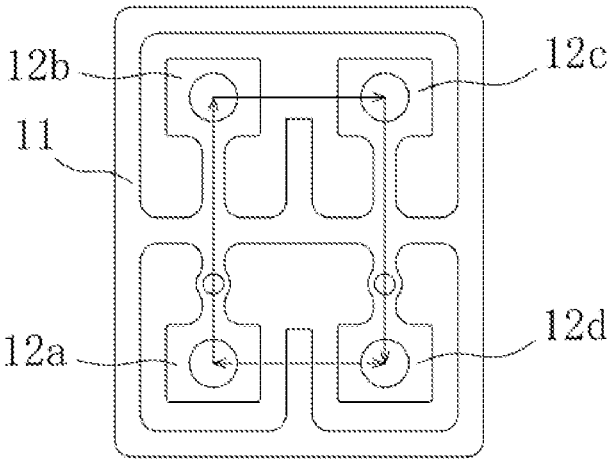
FIG. 2 is a structural diagram of a resonant structure of the cross-coupled filter according to Embodiment 1 of the present disclosure.

As shown in FIG. 1 and FIG. 2, the cross-coupled filter according to Embodiment 1 of the present disclosure includes a resonant structure 1, a top cover 2, a bottom cover 3, a signal input port 4, and a signal output port 5. The structures of the cover 2, the bottom cover 3, the signal input port 4, and the signal output port 5 can be referred to the above description, which will not be repeated here, and the structure of the resonant structure 1 is explained as follows.

As shown in FIG. 2, the filter formed by the resonant structure 1 of Embodiment 1 of the present disclosure is a fourth order filter, which includes a frame 11 and two columns of resonant units integrally formed in the frame 11, and each column of resonant units includes two resonators 12, i.e., there are four resonators 12 arranged in the frame, for ease of description, the four resonators are defined as resonator 12*a*, resonator 12*b*, . . . , resonator 12*d*, in which the resonator 12*a* and the resonator 12*b* are in one column, the resonator 12*c* and the resonator 12*d* are in another column. The structure of each resonator is as described above and will not be repeated here.

The two columns of resonators 12 are distributed in the frame along the left and right directions of the left and right walls of the frame. And the four resonators are arranged in the frame according to the U-shaped signal transmission path. Specifically, the signal is input from the resonator 12*a*, passes through the resonator 12*b* and the resonator 12*c* in turn, and finally outputs from the resonator 12*d*, that is, the signal input port of Embodiment 1 is electrically connected to the resonator 12*a*, and the signal output port is electrically connected to the resonator 12*d*.

Figure 3:
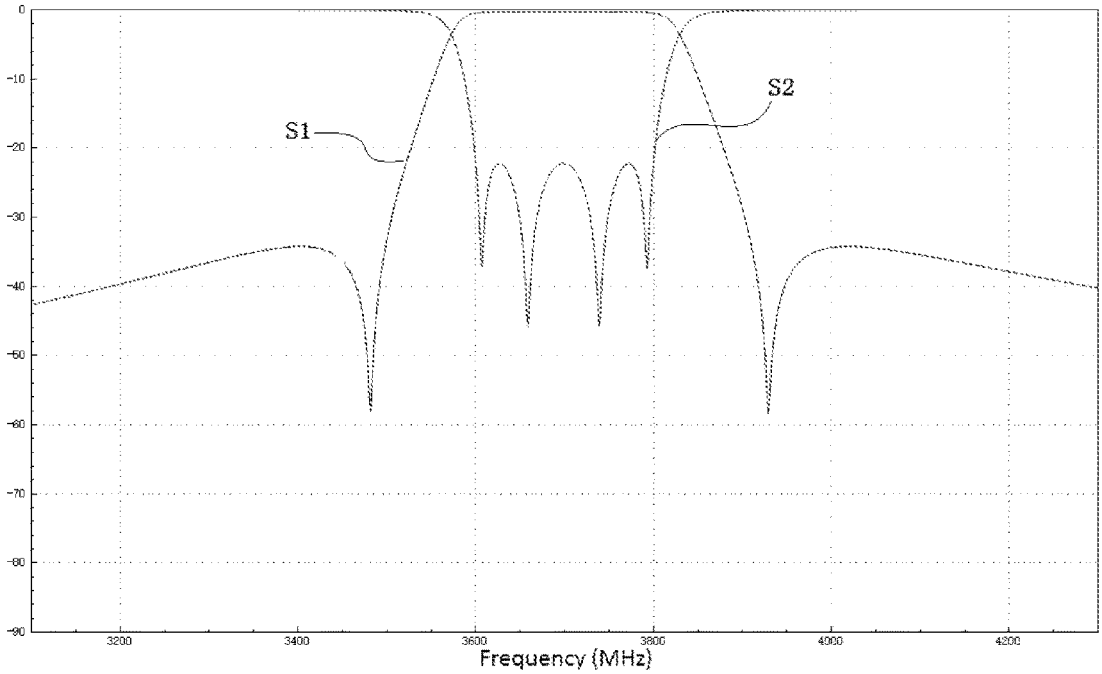
FIG. 3 is a simulated waveform diagram of the cross-coupled filter according to Embodiment 1 of the present disclosure.

The resonator 12*a* and the resonator 12*b* in the same column, the resonator 12*c* and the resonator 12*d* in the same column are dominantly magnetically coupled. The resonator 12*b* and the resonator 12*c* in different columns are dominantly electrically coupled. The cross-coupling (defined as the first cross-coupling) generated between the resonator 12*a* and the resonator 12*d* in different columns is dominant magnetic coupling which is a different dominant mode from (i.e., which is opposite to) the dominant electrical coupling between the resonator 12*b* and the resonator 12*c*. That is, the dominant electrical coupling is formed between the resonator 12*b* and the resonator 12*c* and the dominant magnetic coupling is formed between the resonator 12*a* and the resonator 12*d*, i.e., the alternating form of the dominant electrical coupling and the dominant magnetic coupling for groups of two resonators in the different columns is achieved. And the first cross-coupling is opposite to the coupling formed between the two resonators (that is, the resonator 12*b* and the resonator 12*c*) after the first cross-coupling. This embodiment 1 forms one cross-coupling, and each cross-coupling respectively generates a transmission zero point around each side of the bandwidth, thereby generating a total of two transmission zero points, as shown in FIG. 3.

Specifically, the resonant tails of the resonator 12*a* and the resonator 12*b* are connected and integrally formed with the left side wall of the frame to form a dominant magnetic coupling, while the resonant heads are arranged towards the back side wall or the front side wall of respective frames, and are not in contact with the back side wall and the front side wall; similarly, the resonant tails of the resonator 12*c* and the resonator 12*d* are connected and integrally formed with the right side wall of the frame to form a dominant magnetic coupling, and the resonant heads are arranged towards the back side wall or the front side wall of respective frames, and are not in contact with the back side wall and the front side wall. A partition wall is disposed between the resonator 12*b* and the resonator 12*c*, such that a dominant electrical coupling is formed between the resonator 12*b* and the resonator 12*c*; a partition wall is disposed between the resonator 12*a* and the resonator 12*d*, such that a dominant magnetic coupling formed between the resonator 12*a* and the resonator 12*d*.

As an alternative, the resonators 12*b* and 12*c* in different columns can also be dominantly magnetically coupled. In this way, the first cross-coupling generated between the resonators 12*a* and 12*d* in the different columns is a dominant electrical coupling, which is opposite to the dominant magnetic coupling between the resonators 12*b* and 12*c*. That is, the dominant magnetic coupling is formed between the resonators 12*b* and 12*c*, and the dominant electrical coupling is formed between the resonators 12*a* and 12*d*, respectively, that is, the dominant magnetic coupling and the dominant electrical coupling are in alternating form for groups of adjacent resonators in different columns.

Embodiment 2

Figure 4:
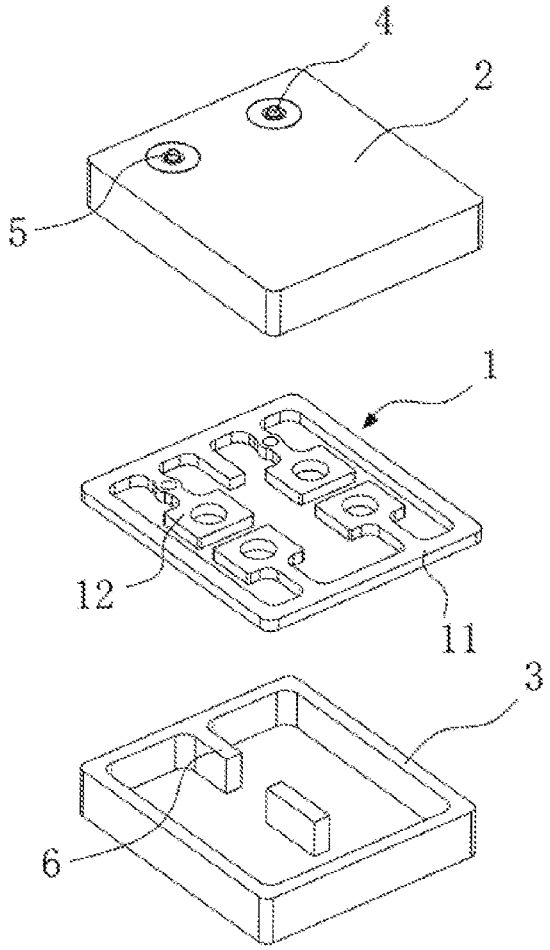
FIG. 4 is an exploded view of a cross-coupled filter according to Embodiment 2 of the present disclosure.
Figure 5:
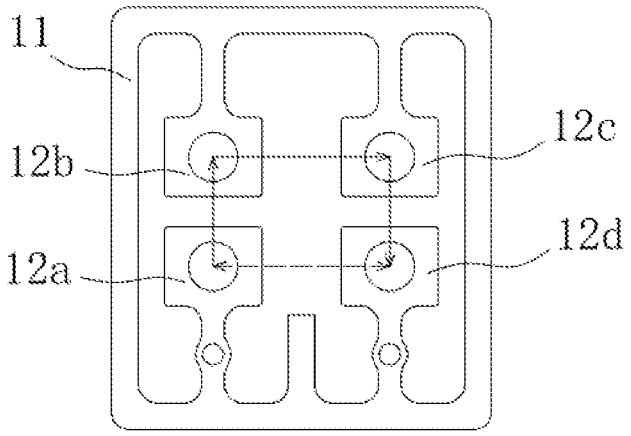
FIG. 5 is a structural diagram of a resonant structure of the cross-coupled filter according to Embodiment 2 of the present disclosure.
Figure 6:
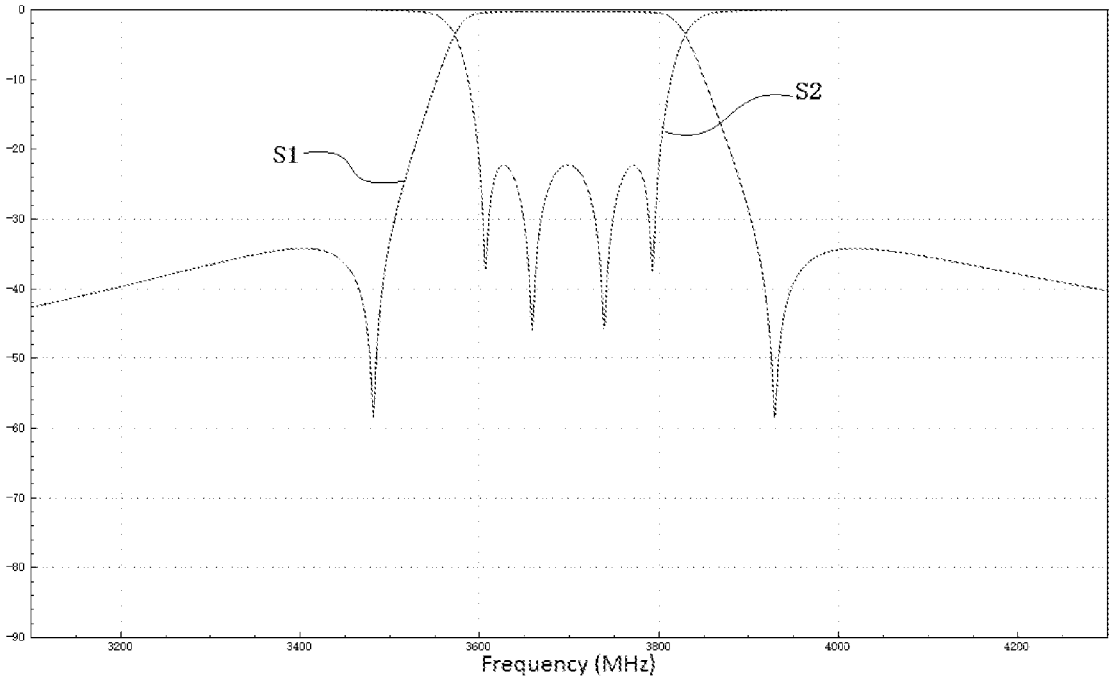
FIG. 6 is a simulated waveform diagram of the cross-coupled filter according to Embodiment 2 of the present disclosure.

With reference to FIG. 4 and FIG. 5, a cross-coupled filter according to Embodiment 2 of the present disclosure includes a resonant structure 1, a top cover 2, a bottom cover 3, a signal input port 4, and a signal output port 5. The filter formed by the resonant structure of Embodiment 2 of the present disclosure is also a fourth order filter, unlike Embodiment 1, as shown in FIG. 5, the resonator 12*a* and the resonator 12*b* in the same column are dominantly electrically coupled, the resonator 12*c* and the resonator 12*d* in the same column are dominantly electrically coupled, the resonator 12*b* and the resonator 12*c* in different columns are dominantly magnetically coupled, and the cross-coupling (defined as the first cross-coupling) generated between the resonator 12*a* and the resonator 12*d* in different columns is dominant electrical coupling which is opposite to the dominant magnetic coupling between the resonator 12*b* and the resonator 12*c*. That is, the dominant magnetic coupling between the resonator 12*b* and the resonator 12*c*, and the dominant electrical coupling between the resonator 12*a* and the resonator 12*d*, are formed respectively, i.e., the alternating coupling of the dominant electrical coupling and the dominant magnetic coupling is formed for groups of adjacent resonators in different columns. This embodiment 2 forms one cross-coupling, and each cross-coupling respectively generates a transmission zero point around each side of the bandwidth, thereby generating a total of two transmission zero points, as shown in FIG. 6.

Specifically, the resonant tail of the resonator 12*a* and the back side wall of the frame are integrally formed, the resonant heads of the resonator 12*a* and the resonator 12*b* are arranged to face each other and a coupling gap is formed therebetween to form a dominant electrical coupling, the resonant tail of the resonator 12*b* and the front side wall of the frame are integrally formed; similarly, the resonant tail of the resonator 12*c* and the back side wall of the frame are integrally formed, the resonant heads of the resonator 12*c* and the resonator 12*d* are arranged to face each other and a coupling gap is formed therebetween to form a dominant electrical coupling, the resonant tail of the resonator 12*d* and the front side wall of the frame are integrally formed. A partition wall disposed between the resonator 12*b* and the resonator 12*c* is arranged within the bottom cover 3, such that a dominant magnetic coupling formed between the resonator 12*b* and the resonator 12*c*; a partition wall disposed between the resonator 12*a* and the resonator 12*d* is arranged on the frame, such that a dominant electrical coupling formed between the resonator 12*a* and the resonator 12*d*.

As an alternative, the resonators 12*b* and 12*c* in different columns can also be dominantly electrically coupled. In this way, the first cross-coupling generated between the resonators 12*a* and 12*d* in the different columns is a dominant magnetic coupling, which is opposite to the dominant electrical coupling between the resonator 12*b* and the resonator 12*c*. That is, the dominant electrical coupling between the resonators 12*b* and 12*c*, and the dominant magnetic coupling between the resonators 12*a* and 12*d*, are formed respectively, that is, the dominant electrical coupling and the dominant magnetic coupling are in alternating form for groups of adjacent resonators in different columns.

Embodiment 3

Figure 7:
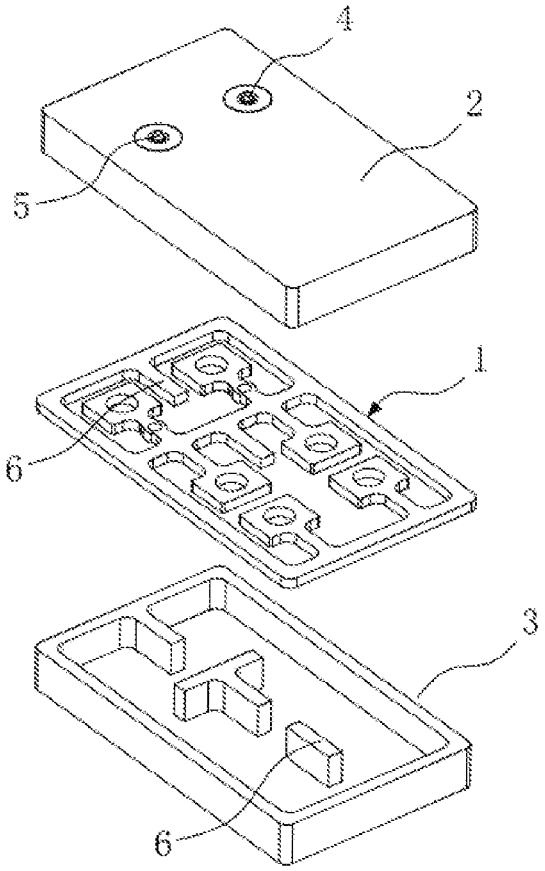
FIG. 7 is an exploded view of a cross-coupled filter according to Embodiment 3 of the present disclosure.
Figure 8:
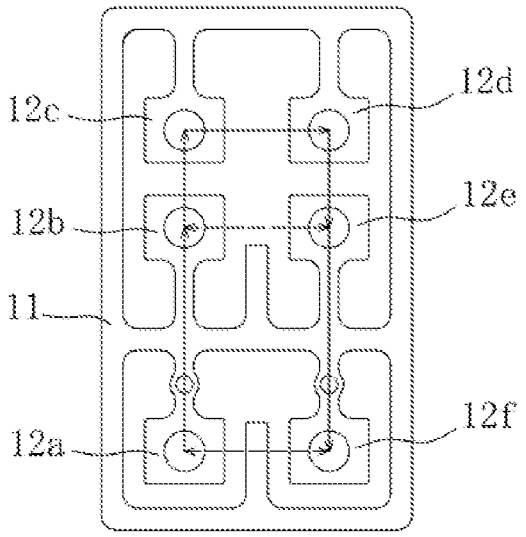
FIG. 8 is a structural diagram of a resonant structure of the cross-coupled filter according to Embodiment 3 of the present disclosure.

As shown in FIG. 7 and FIG. 8, a cross-coupled filter according to Embodiment 3 of the present disclosure includes a resonant structure 1, a top cover 2, a bottom cover 3, a signal input port 4, and a signal output port 5. The structures of the cover 2, the bottom cover 3, the signal input port 4, and the signal output port 5 can be referred to the above description, which will not be repeated here, and the structure of the resonant structure 1 is explained below.

As shown in FIG. 8, the filter formed by the resonant structure 1 of Embodiment 6 of the present disclosure is a sixth order filter, which includes a frame 11 and two columns of resonant units integrally formed in the frame 11, and each column of resonant units includes 3 resonators, i.e., there are six resonators 12 arranged in the frame, for ease of description, the six resonators are defined as resonator 12*a*, resonator 12*b* . . . resonator 12*f*, in which the resonator 12*a*, the resonator 12*b*, and the resonator 12*c* are in one column, the resonator 12*d*, the resonator 12*e* and the resonator 12*f* are in another column. The structure of each resonator is as described above and will not be repeated here.

The two columns of resonators 12 are distributed in the frame along the left and right directions of the left and right walls of the frame. And the six resonators are arranged in the frame according to the U-shaped signal transmission path. Specifically, the signal is input from the resonator 12*a*, passes through the resonator 12*b* to the resonator 12*e* in turn, and finally outputs from the resonator 12*f*, that is, the signal input port of Embodiment 3 is electrically connected to the resonator 12*a*, and the signal output port is electrically connected to the resonator 12*f*.

Figure 9:
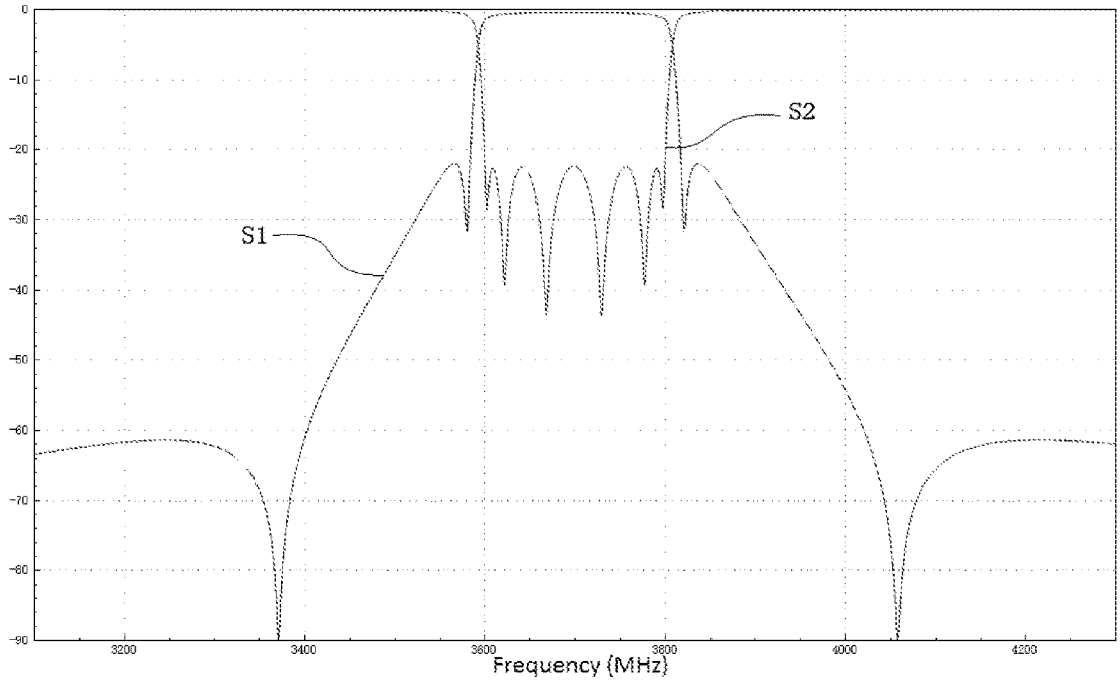
FIG. 9 is a simulated waveform diagram of the cross-coupled filter according to Embodiment 3 of the present disclosure.

Among them, the resonator 12*a* and the resonator 12*b* in the same column are dominantly magnetically coupled, the resonator 12*b* and the resonator 12*c* are dominantly electrically coupled, which means that a plurality of groups of adjacent resonators in the same column are dominantly magnetically coupled and dominantly electrically coupled in an alternating form; similarly, the resonator 12*d* and the resonator 12*e* in the same column are dominantly electrically coupled, the resonator 12*e* and the resonator 12*f* are dominantly magnetically coupled. The resonator 12*c* and the resonator 12*d* in different columns are dominantly magnetically coupled, and the cross-coupling (defined as the first cross-coupling) generated between the resonator 12*b* and the resonator 12*e* in different columns is dominant electrical coupling which is opposite to the dominant magnetic coupling between the resonator 12*c* and the resonator 12*d*. The cross-coupling (defined as the second cross-coupling) generated between the resonator 12*a* and the resonator 12*f* in different columns is dominant magnetic coupling which is opposite to the dominant electrical coupling between the resonator 12*b* and the resonator 12*e*. That is, the dominant magnetic coupling between the resonator 12*c* and the resonator 12*d*, the dominant electrical coupling between the resonator 12*b* and the resonator 12*e*, and the dominant magnetic coupling between the resonator 12*a* and the resonator 12*f* are formed respectively, i.e., the alternating coupling of the dominant magnetic coupling and the dominant electrical coupling is formed for groups of adjacent resonators in different columns. And the first cross-coupling is opposite to the coupling formed between the two resonators (that is, the resonator 12*c* and the resonator 12*d*) after the first cross-coupling, the second cross-coupling is opposite to the first cross-coupling. This embodiment 3 forms two cross-couplings, and each cross-coupling respectively generates a transmission zero point around each side of the bandwidth, thereby generating a total of four transmission zero points, as shown in FIG. 9.

Specifically, the resonant tails of the resonator 12*a* and the resonator 12*b* are connected and integrally formed with the left side wall of the frame to form a dominant magnetic coupling, while the resonance heads thereof face the opposite directions, wherein the resonance head of the resonator 12*a* faces the back side wall of the frame, the resonant head of the resonator 12*b* is opposite to the resonant head of the resonator 12*c* to form a dominant electrical coupling. The resonant tail of the resonator 12*c* is integrally formed with the front side wall of the frame; the structure of the resonator 12*d*, the resonator 12*e*, and the resonator 12*f* in another column is the same as the structure of the resonator 12*a*, the resonator 12*b*, and the resonator 12*c*, which will not be repeated here.

A partition wall disposed between the resonator 12*c* and the resonator 12*d* is arranged on the bottom cover 3, such that the dominant magnetic coupling is formed between the resonator 12*c* and the resonator 12*d*; a partition wall is disposed between the resonator 12*b* and the resonator 12*e*, such that the dominant electrical coupling is formed between the resonator 12*b* and the resonator 12*e*; a partition wall is disposed between the resonator 12*a* and the resonator 12*f*, such that the dominant magnetic coupling is between the resonator 12*a* and the resonator 12*f*.

As an alternative, the resonators 12*c* and 12*d* in different columns can also be dominantly electrically coupled. In this way, a first cross-coupling generated between the resonators 12*b* and 12*e* in the different columns is a dominant magnetic coupling, which is opposite to the dominant electrical coupling between the resonators 12*c* and 12*d*, a second cross-coupling generated between the resonators 12*a* and 12*f* in the different columns is a dominant electrical coupling, which is opposite to the dominant magnetic coupling formed between the resonators 12*b* and 12*e*. That is, the dominant electrical coupling between the resonators 12*c* and 12*d*, the dominant magnetic coupling between the resonators 12*b* and 12*e*, and the dominant electrical coupling between the resonators 12*a* and 12*f*, are formed respectively, that is, the dominant coupling modes alternate between electrical coupling and magnetic coupling for groups of adjacent resonators in different columns.

Embodiment 4

Figure 10:
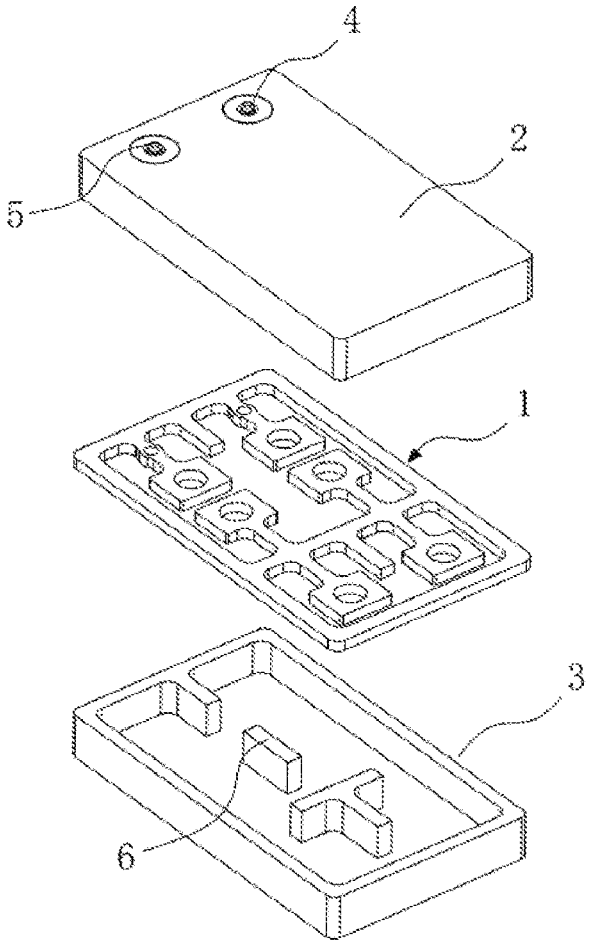
FIG. 10 is an exploded view of a cross-coupled filter according to Embodiment 4 of the present disclosure.
Figure 11:
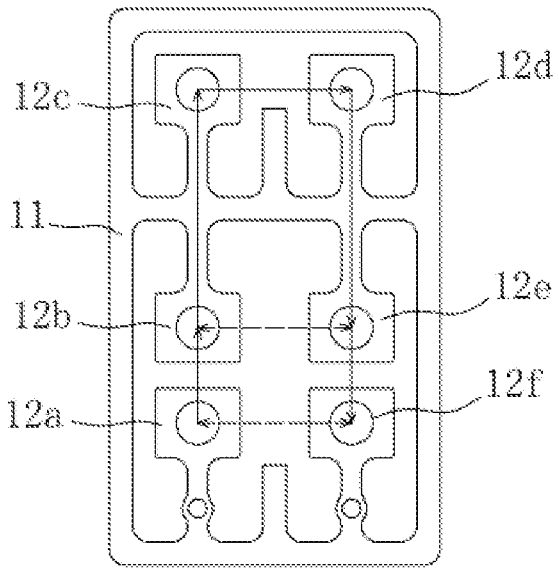
FIG. 11 is a structural diagram of a resonant structure of the cross-coupled filter according to Embodiment 4 of the present disclosure.

With reference to FIG. 10 and FIG. 11, a cross-coupled filter according to Embodiment 4 of the present disclosure includes a resonant structure 1, a top cover 2, a bottom cover 3, a signal input port 4, and a signal output port 5. The filter formed by the resonant structure of Embodiment 4 of the invention is also a sixth order filter, as shown in FIG. 11, unlike Embodiment 3, the resonator 12*a* and the resonator 12*b* in the same column are dominantly electrically coupled, the resonator 12*b* and the resonator 12*c* are dominantly magnetically coupled, that is, a plurality of groups of adjacent resonators in the same column are dominantly electrically coupled and dominantly magnetically coupled in an alternating form; similarly, the resonator 12*d* and the resonator 12*e* in the same column are dominantly magnetically coupled, the resonator 12*e* and the resonator 12*f* are dominantly electrically coupled.

Figure 12:
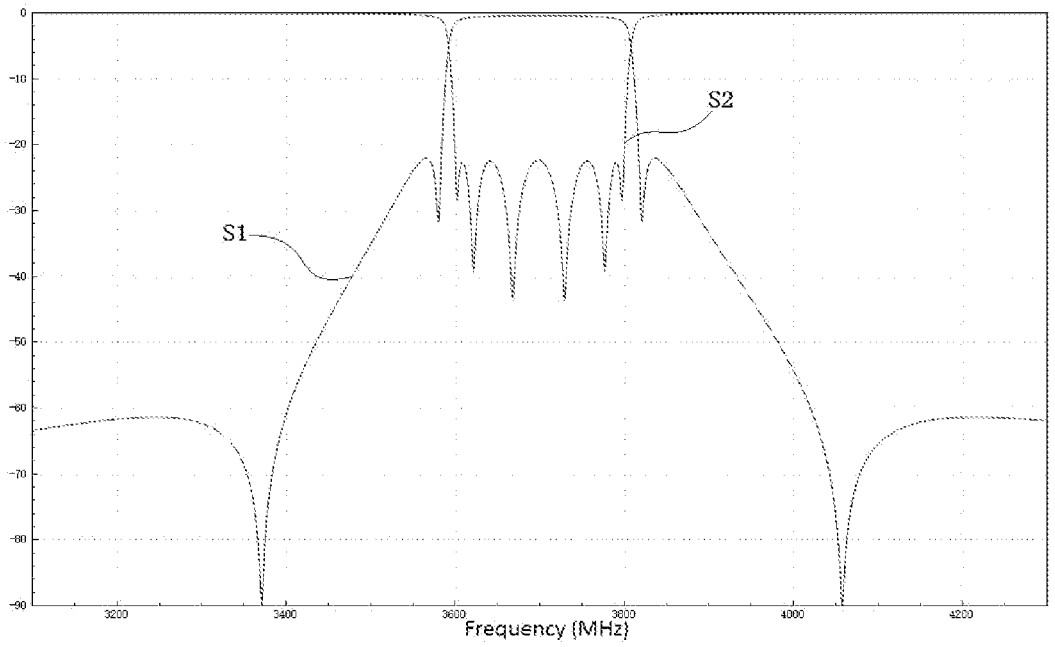
FIG. 12 is a simulated waveform diagram of the cross-coupled filter according to Embodiment 4 of the present disclosure.

The resonator 12*c* and the resonator 12*d* in different columns are dominantly electrically coupled, and the cross-coupling (defined as the first cross-coupling) generated between the resonators 12*b* and 12*e* in different columns is a dominant magnetic coupling, which is opposite to the dominant electrical coupling formed between resonators 12*c* and 12*d*, and the cross-coupling (defined as the second cross-coupling) between the resonators 12*a* and 12*f* in different columns is a dominant electrical coupling, which is opposite to the dominant magnetic coupling formed between resonators 12*b* and 12*e*, that is, the dominant electrical coupling between the resonators 12*c* and 12*d*, the dominant magnetic coupling between the resonator 12*b* and 12*e*, and the dominant electrical coupling between the resonators 12*a* and 12*f* are formed respectively, that is, dominant coupling modes alternating between electric coupling and magnetic coupling for groups of adjacent resonators in different columns is achieved. Similarly, the first cross-coupling is opposite to the coupling formed between the two resonators (that is, the resonator 12*c* and the resonator 12*d*) after the first cross-coupling, the second cross-coupling is opposite to the first cross-coupling. The embodiment 4 forms two cross-couplings, and each cross-coupling respectively generates a transmission zero point around each side of the bandwidth, thereby generating a total of four transmission zero points, as shown in FIG. 12.

Specifically, the resonant tail of the resonator 12*a* and the back side wall of the frame are integrally formed, the resonant heads of the resonator 12*a* and the resonator 12*b* are arranged to face each other to form a dominant electrical coupling, the resonant tail of the resonator 12*b* and the resonant tail of the resonator 12*c* and the left side wall of the frame are integrally formed to form a dominant magnetic coupling, the resonant head of the resonator 12*c* is arranged toward the front side wall of the frame; the structure of the resonator 12*d*, the resonator 12*e*, and the resonator 12*f* in another column is the same as the structure of the resonator 12*a*, the resonator 12*b*, and the resonator 12*c*, which will not be repeated here.

A partition wall is disposed between the resonator 12*c* and the resonator 12*d*, such that the dominant electrical coupling is formed between the resonator 12*c* and the resonator 12*d*; a partition wall is disposed between the resonator 12*b* and the resonator 12*e*, such that the dominant magnetic coupling is formed between the resonator 12*b* and the resonator 12*e*; a partition wall is disposed between the resonator 12*a* and the resonator 12*f*, such that the dominant electrical coupling is between the resonator 12*a* and the resonator 12*f*.

As an alternative, the resonators 12*c* and 12*d* in different columns can also be dominantly magnetically coupled. In this way, a first cross-coupling generated between the resonators 12*b* and 12*e* in the different columns is a dominant electrical coupling, which is opposite to the dominant magnetic coupling between the resonators 12*c* and 12*d*, a second cross-coupling generated between the resonators 12*a* and 12*f* in the different columns is a dominant magnetic coupling, which is opposite to the dominant electrical coupling formed between the resonators 12*b* and 12*e*. That is, the dominant magnetic coupling between the resonators 12*c* and 12*d*, the dominant electrical coupling between the resonators 12*b* and 12*e*, and the dominant magnetic coupling between the resonators 12*a* and 12*f* are formed, respectively, that is, the dominant magnetic coupling and the dominant electrical coupling are alternating for groups of adjacent resonators in different columns.

Embodiment 5

Figure 15:
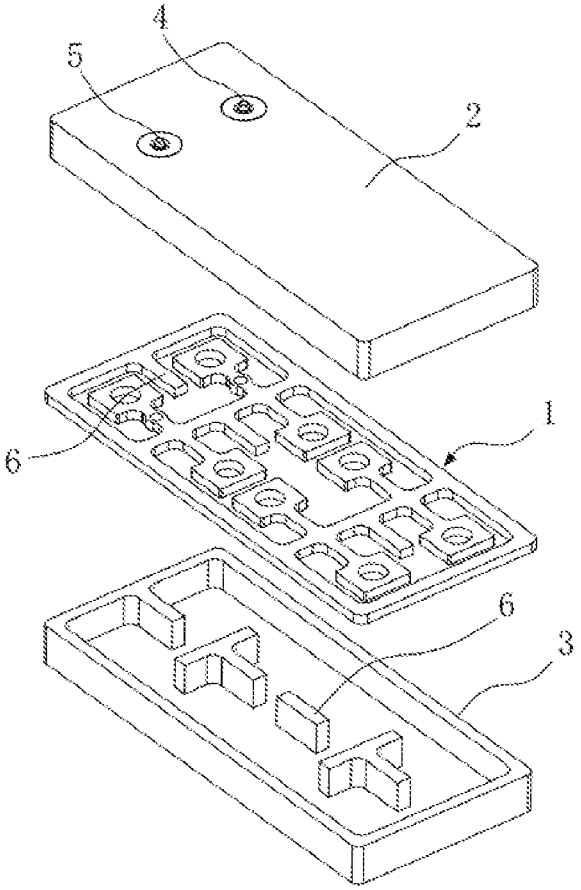
FIG. 15 is an exploded view of a cross-coupled filter according to Embodiment 5 of the present disclosure.
Figure 16:
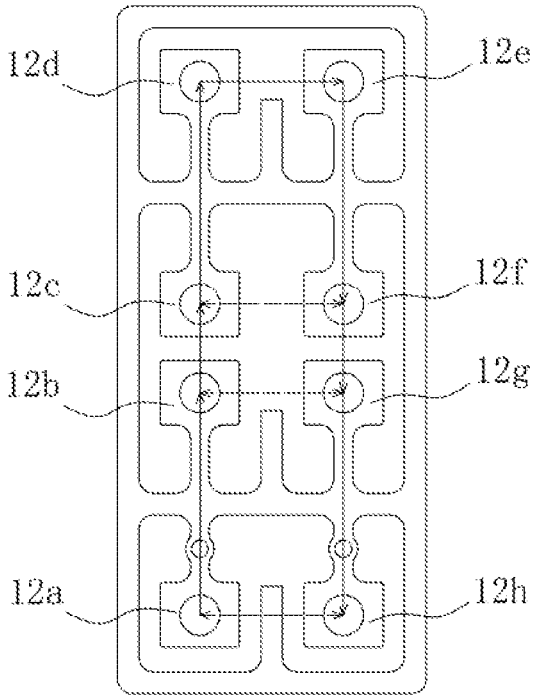
FIG. 16 is a structural diagram of a resonant structure of the cross-coupled filter according to Embodiment 5 of the present disclosure.

With reference to FIG. 15 and FIG. 16, a cross-coupled filter according to Embodiment 5 of the present disclosure includes a resonant structure 1, a top cover 2, a bottom cover 3, a signal input port 4, and a signal output port 5. The filter formed by the resonant structure of Embodiment 5 of the invention is a eighth order filter, which includes a frame and two columns of resonant units integrally formed in the frame, each column of resonant units includes 4 resonators, that is, 8 resonators are arranged in the frame, as shown in FIG. 16, for ease of description, the eight resonators are defined as resonator 12*a*, resonator 12*b* . . . resonator 12*h*, wherein resonator 12*a*~resonator 12*d* are in one column, and resonator 12*e*~the resonators 12*h* are in another column. The structure of each resonator is as described above and will not be repeated here.

Two columns of resonators are distributed in the frame along the left and right directions of the left and right walls of the frame. And the eight resonators are arranged in the frame according to the U-shaped signal transmission path. Specifically, the signal is input from the resonator 12*a*, passes through the resonator 12*b* to the resonator 12*g* in turn, and finally outputs from the resonator 12*h*, that is, the signal input port of Embodiment 5 is electrically connected to the resonator 12*a*, and the signal output port is electrically connected to the resonator 12*h*.

Figure 17:
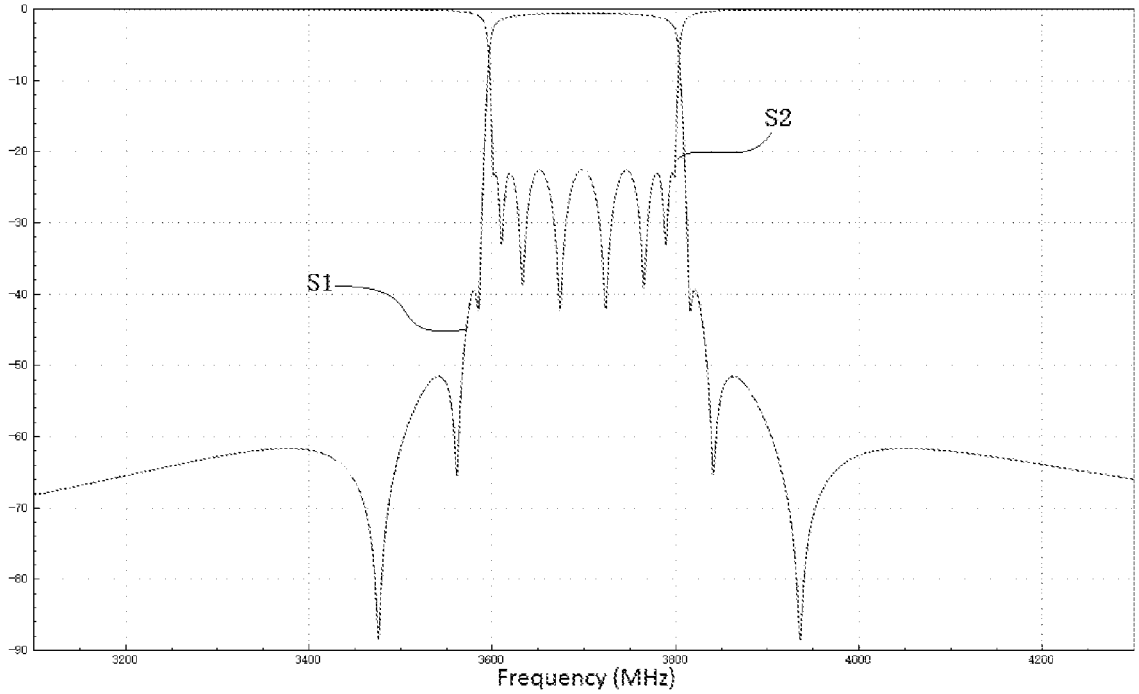
FIG. 17 is a simulated waveform diagram of the cross-coupled filter according to Embodiment 5 of the present disclosure.

Among them, the resonator 12*a* and the resonator 12*b* in the same column are dominantly magnetically coupled, the resonator 12*b* and the resonator 12*c* are dominantly electrically coupled, the resonator 12*c* and the resonator 12*d* are dominantly magnetically coupled, which means that a plurality of groups of adjacent resonators in the same column are dominantly magnetically coupled and dominantly electrically coupled in an alternating form; similarly, the resonator 12*e* and the resonator 12*f* in the same column are dominantly magnetically coupled, the resonator 12*f* and the resonator 12*g* are dominantly electrically coupled, and the resonator 12*g* and the resonator 12*h* are dominantly magnetically coupled. The resonator 12*d* and the resonator 12*e* in different columns are dominantly electrically coupled, and the cross-coupling (defined as the first cross-coupling) generated between the resonator 12*c* and the resonator 12*f* in different columns is dominant magnetic coupling which is opposite to the dominant electrical coupling between the resonator 12*d* and the resonator 12*e*. The cross-coupling (defined as the second cross-coupling) generated between the resonator 12*b* and the resonator 12*g* in different columns is dominant electrical coupling which is opposite to the dominant magnetic coupling between the resonator 12*c* and the resonator 12*f*. The cross-coupling (defined as the third cross-coupling) generated between the resonator 12*a* and the resonator 12*h* in different columns is dominant magnetic coupling which is opposite to the dominant electrical coupling between the resonator 12*b* and the resonator 12*g*. That is, the dominant electrical coupling between the resonator 12*d* and the resonator 12*e*, the dominant magnetic coupling between the resonator 12*c* and the resonator 12*f*, the dominant electrical coupling between the resonator 12*b* and the resonator 12*g*, and the dominant magnetic coupling between the resonator 12*a* and the resonator 12*h* are formed respectively, i.e., the dominant coupling modes alternating between electrical coupling and magnetic coupling is achieved for groups of adjacent resonators in different columns. And the first cross-coupling is opposite to the coupling formed between the two resonators (that is, the resonator 12*d* and the resonator 12*e*) after the first cross-coupling in the form of coupling, the second cross-coupling is opposite to the first cross-coupling in the form of coupling, and the third cross-coupling is opposite to the second cross-coupling in the form of coupling. The embodiment 5 forms three cross-couplings, and each cross-coupling respectively generates a transmission zero point around each side of the bandwidth, thereby generating a total of six transmission zero points, as shown in FIG. 17.

Specifically, the resonant tails of the resonator 12*a* and the resonator 12*b* are connected and integrally formed with the left side wall of the frame to form a dominant magnetic coupling, while the resonance heads thereof face the opposite directions, wherein the resonance head of the resonator 12*a* faces the back side wall of the frame, the resonant head of the resonator 12*b* is opposite to the resonant head of the resonator 12*c* to form a dominant electrical coupling. The resonant tails of the resonator 12*c* and the resonator 12*d* are connected and integrally formed with the left side wall of the frame to form a dominant magnetic coupling; the structure of the resonator 12*e*~the resonator 12*f* in another column is the same as the structure of the resonator 12*a*~the resonator 12*d*, which will not be repeated here.

A partition wall is disposed between the resonator 12*d* and the resonator 12*e*, such that the dominant electrical coupling is formed between the resonator 12*d* and the resonator 12*e*; a partition wall is disposed between the resonator 12*c* and the resonator 12*f*, such that the dominant magnetic coupling is formed between the resonator 12*c* and the resonator 12*f*; a partition wall is disposed between the resonator 12*b* and the resonator 12*g*, such that the dominant electrical coupling is between the resonator 12*b* and the resonator 12*g*; a partition wall is disposed between the resonator 12*a* and the resonator 12*h*, such that the dominant magnetic coupling is formed between the resonator 12*a* and the resonator 12*h*.

As an alternative, the resonators 12*d* and 12*e* in different columns can also be dominantly magnetically coupled. In this way, a first cross-coupling generated between the resonators 12*c* and 12*f* in the different columns is a dominant electrical coupling, which is opposite to the dominant magnetic coupling between the resonators 12*d* and 12*e*, a second cross-coupling generated between the resonators 12*b* and 12*g* in the different columns is a dominant magnetic coupling, which is opposite to the dominant electrical coupling formed between the resonators 12*c* and 12*f*, and a third cross-coupling generated between the resonators 12*a* and 12*h* in the different columns is a dominant electrical coupling, which is opposite to the dominant magnetic coupling between the resonators 12*b* and 12*g*. That is, the dominant magnetic coupling between the resonators 12*d* and 12*e*, the dominant electrical coupling between the resonators 12*c* and 12*f*, the dominant magnetic coupling between the resonators 12*b* and 12*g*, and the dominant electrical coupling between the resonators 12*a* and 12*h* are formed respectively, that is, the dominant magnetic coupling and the dominant electrical coupling are alternating for groups of adjacent resonators in different columns.

Embodiment 6

Figure 20:
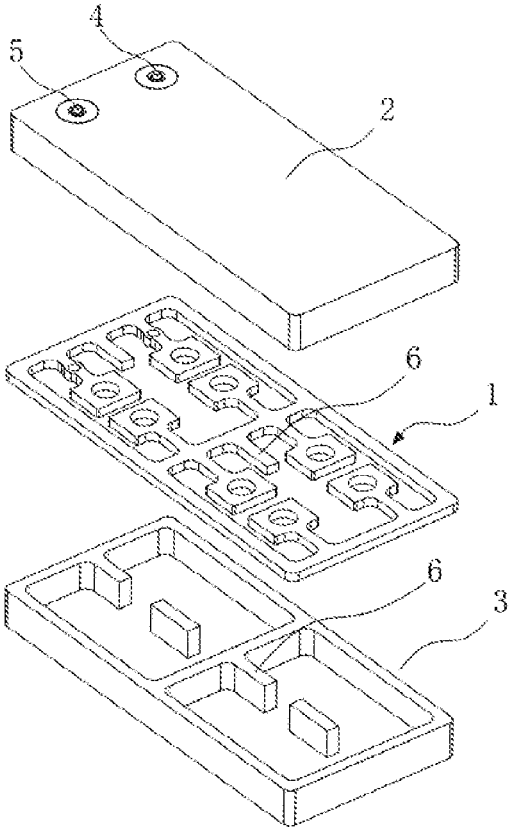
FIG. 20 is an exploded view of a cross-coupled filter according to Embodiment 6 of the present disclosure.
Figure 21:
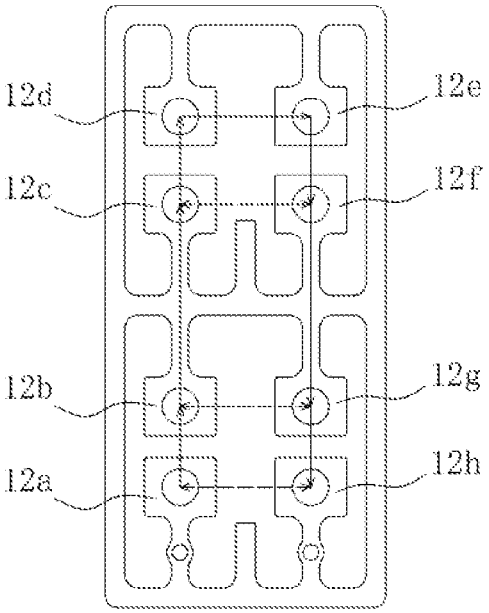
FIG. 21 is a structural diagram of a resonant structure of the cross-coupled filter according to Embodiment 6 of the present disclosure.
Figure 22:
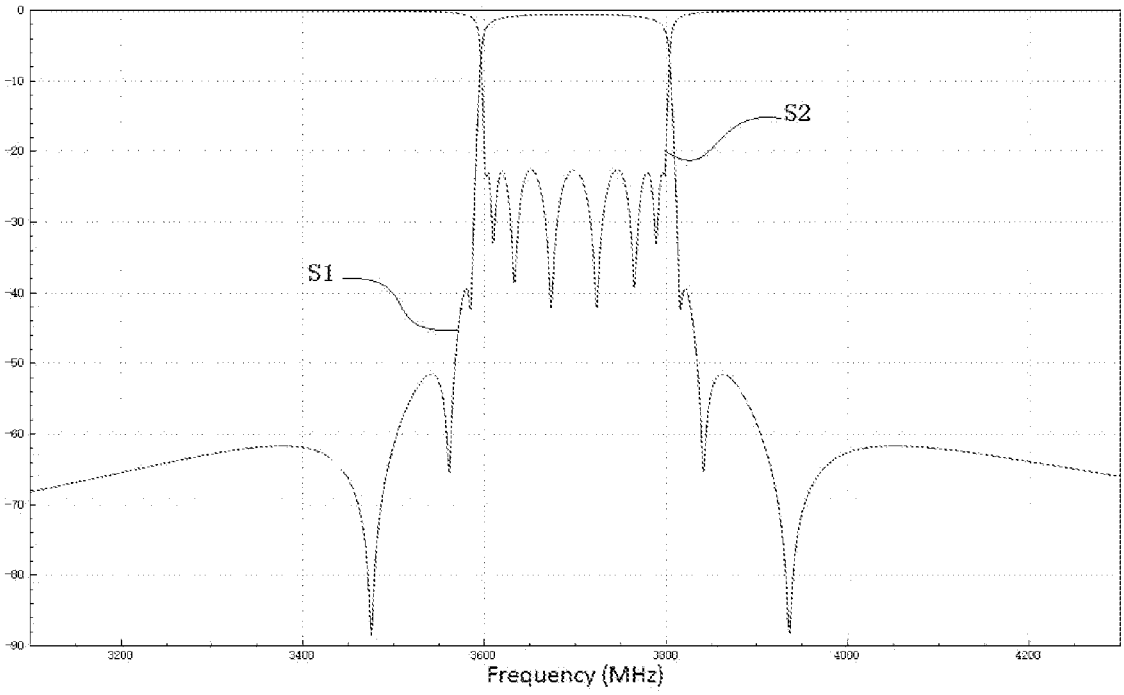
FIG. 22 is a simulated waveform diagram of the cross-coupled filter according to Embodiment 6 of the present disclosure.
Figure 23:
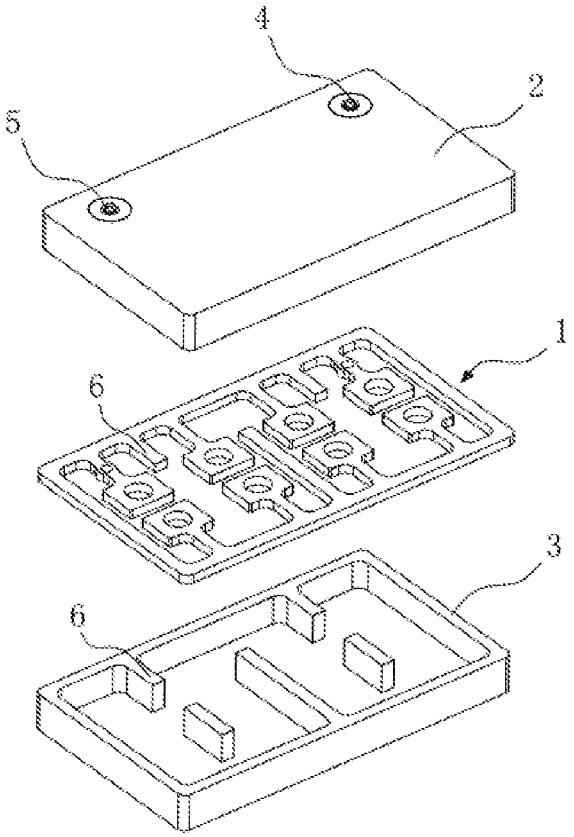
FIG. 23 is an exploded view of an alternative cross-coupled filter according to Embodiment 6 of the present disclosure.
Figure 24:
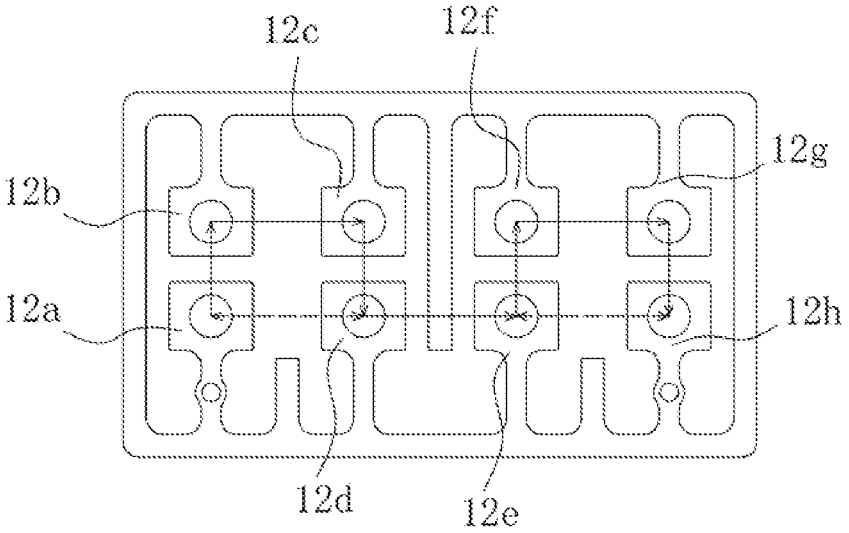
FIG. 24 is a structural diagram of a resonant structure of the alternative cross-coupled filter according to Embodiment 6 of the present disclosure.
Figure 25:
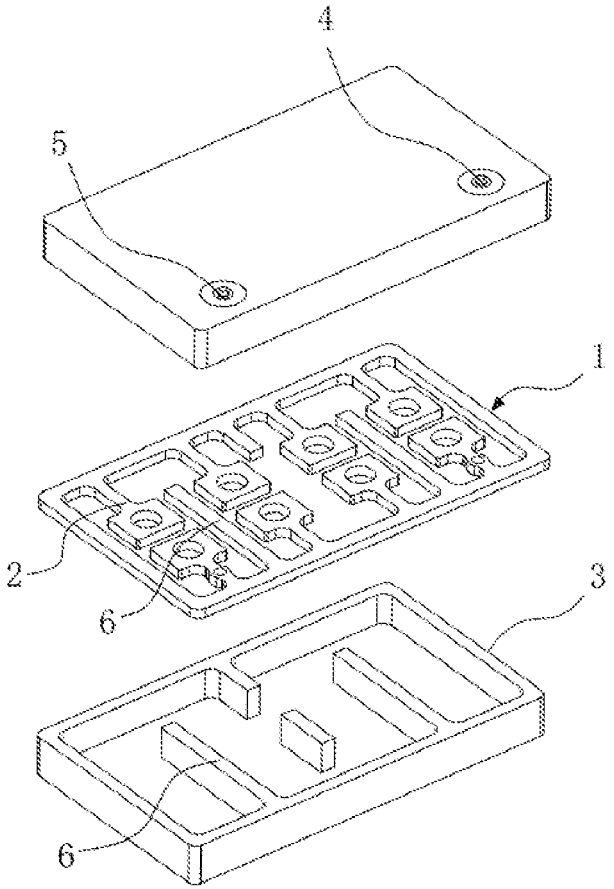
FIG. 25 is a structural diagram of a resonant structure of another alternative cross-coupled filter according to Embodiment 6 of the present disclosure.
Figure 26:
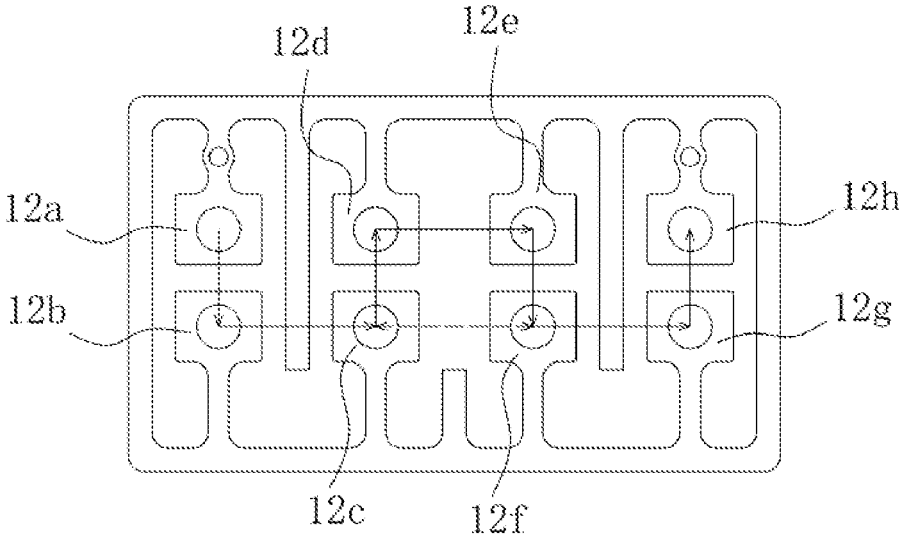
FIG. 26 is an exploded view of the another alternative the cross-coupled filter according to Embodiment 6 of the present disclosure.

As shown in FIG. 20 and FIG. 21, a cross-coupled filter according to Embodiment 6 of the present disclosure includes a resonant structure 1, a top cover 2, a bottom cover 3, a signal input port 4, and a signal output port 5. The filter formed by the resonant structure of Embodiment 5 of the invention is also a eighth order filter, as shown in FIG. 21, unlike Embodiment 5, the resonator 12*a* and the resonator 12*b* in the same column are dominantly electrically coupled, the resonator 12*b* and the resonator 12*c* are dominantly magnetically coupled, the resonator 12*c* and the resonator 12*d* are dominantly electrically coupled, that is, a plurality of groups of adjacent resonators in the same column are dominantly electrically coupled and dominantly magnetically coupled in an alternating form; similarly, the resonator 12*e* and the resonator 12*f* in the same column are dominantly electrically coupled, the resonator 12*f* and the resonator 12*g* are dominantly magnetically coupled, and the resonator 12*g* and the resonator 12*h* are dominantly electrically coupled. the resonator 12*d* and the resonator 12*e* in different columns are dominantly magnetically coupled, and the cross-coupling (defined as the first cross-coupling) generated between the resonator 12*c* and the resonator 12*f* in different columns is dominantly electrical coupled, which is opposite to the dominant magnetic coupling between the resonator 12*d* and the resonator 12*e*. The cross-coupling (defined as the second cross-coupling) generated between the resonator 12*b* and the resonator 12*g* in different columns is dominant magnetic coupling which is opposite to the dominant electrical coupling between the resonator 12*c* and the resonator 12*f* The cross-coupling (defined as the third cross-coupling) generated between the resonator 12*a* and the resonator 12*h* in different columns is dominant electrical coupling which is opposite to the dominant magnetic coupling between the resonator 12*b* and the resonator 12*g*. That is, the dominant magnetic coupling between the resonator 12*d* and the resonator 12*e*, the dominant electrical coupling between the resonator 12*c* and the resonator 12*f*, the dominant magnetic coupling between the resonator 12*b* and the resonator 12*g*, and the dominant electrical coupling between the resonator 12*a* and the resonator 12*h* are formed respectively, i.e., the alternating of the dominant magnetic coupling and the dominant electrical coupling is formed for groups of adjacent resonators in different columns. And the first cross-coupling is opposite to the coupling formed between the two resonators (that is, the resonator 12*d* and the resonator 12*e*) after the first cross-coupling in the form of coupling, the second cross-coupling is opposite to the first cross-coupling in the form of coupling, and the third cross-coupling is opposite to the second cross-coupling in the form of coupling. The embodiment 6 forms three cross-couplings, and each cross-coupling respectively generates a transmission zero point around each side of the bandwidth, thereby generating a total of six transmission zero points, as shown in FIG. 22.

Specifically, the resonant tail of the resonator 12*a* and the back side wall of the frame are integrally formed, the resonant heads of the resonator 12*a* and the resonator 12*b* are arranged to face each other to form a dominant electrical coupling, the resonant tail of the resonator 12*b* and the resonant tail of the resonator 12*c* and the left side wall of the frame are integrally formed to form a dominant magnetic coupling, the resonant heads of the resonator 12*c* and the resonator 12*d* are arranged to face each other to form a dominant electrical coupling, the resonant head of the resonator 12*d* and the front side wall of the frame are integrally formed; the structure of the resonator 12*e*~the resonator 12*h* in another column is the same as the structure of the resonator 12*a*~the resonator 12*d*, which will not be repeated here.

A partition wall is disposed between the resonator 12*d* and the resonator 12*e*, such that the dominant magnetic coupling is formed between the resonator 12*d* and the resonator 12*e*; a partition wall is disposed between the resonator 12*c* and the resonator 12*f*, such that the dominant electrical coupling is formed between the resonator 12*c* and the resonator 12*f*; a partition wall is disposed between the resonator 12*b* and the resonator 12*g*, such that the dominant magnetic coupling is formed between the resonator 12*b* and the resonator 12*g*, a partition wall is disposed between the resonator 12*a* and the resonator 12*h*, such that the dominant electrical coupling is between the resonator 12*a* and the resonator 12*f*.

As an alternative, the resonators 12*d* and 12*e* in different columns can also be dominantly electrically coupled. In this way, a first cross-coupling generated between the resonators 12*c* and 12*f* in the different columns is a dominant magnetic coupling, which is opposite to the dominant electrical coupling between the resonators 12*d* and 12*e*, a second cross-coupling generated between the resonators 12*b* and 12*g* in the different columns is a dominant electrical coupling, which is opposite to the dominant magnetic coupling formed between the resonators 12*c* and 12*f*, and a third cross-coupling generated between the resonators 12*a* and 12*h* in the different columns is a dominant magnetic coupling, which is opposite to the dominant electrical coupling between the resonators 12*b* and 12*g*. That is, the dominant electrical coupling between the resonators 12*d* and 12*e*, the dominant magnetic coupling between the resonators 12*c* and 12*f*, the dominant electrical coupling between the resonators 12*b* and 12*g*, and the dominant magnetic coupling between the resonators 12*a* and 12*h* are formed, respectively, that is, the dominant coupling modes of two adjacent resonators in same two adjacent columns alternate between electrical coupling and magnetic coupling.

Figure 13:
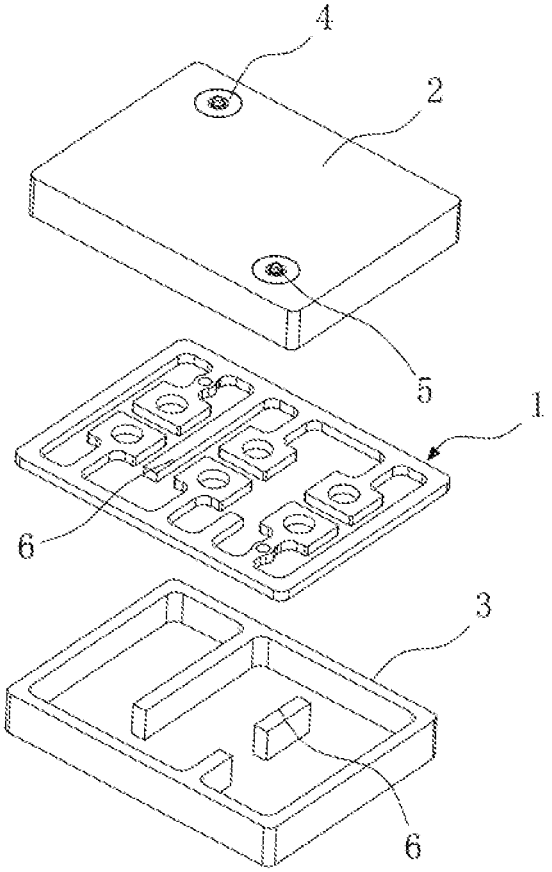
FIG. 13 is an exploded view of an alternative cross-coupled filter according to Embodiment 4 of the present disclosure.
Figure 14:
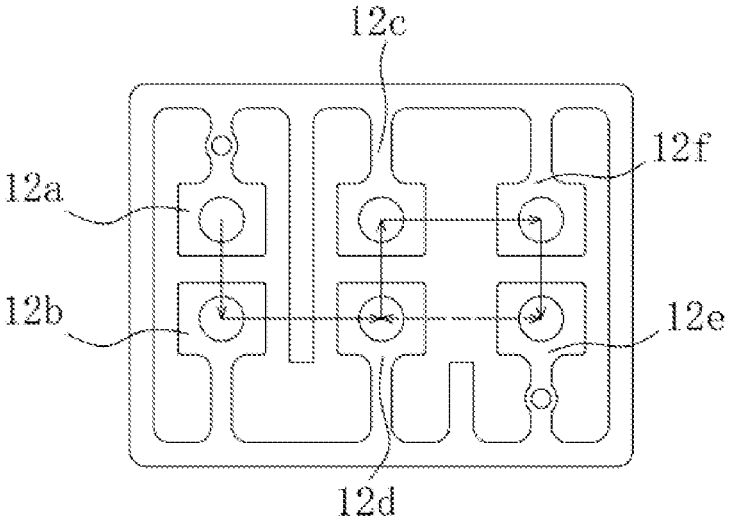
FIG. 14 is a structural diagram of a resonant structure of the alternative cross-coupled filter according to Embodiment 4 of the present disclosure.
Figure 18:
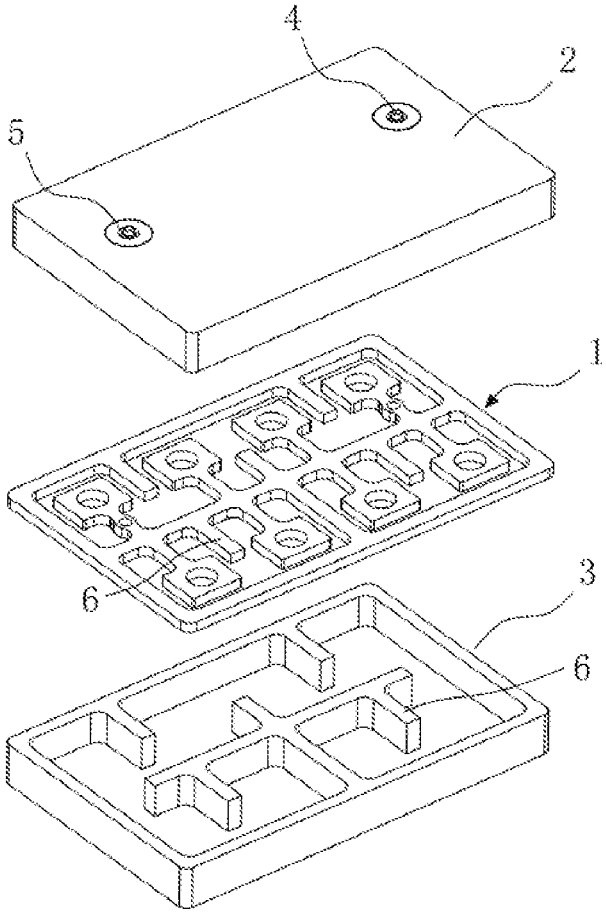
FIG. 18 is an exploded view of an alternative cross-coupled filter according to Embodiment 5 of the present disclosure.
Figure 19:
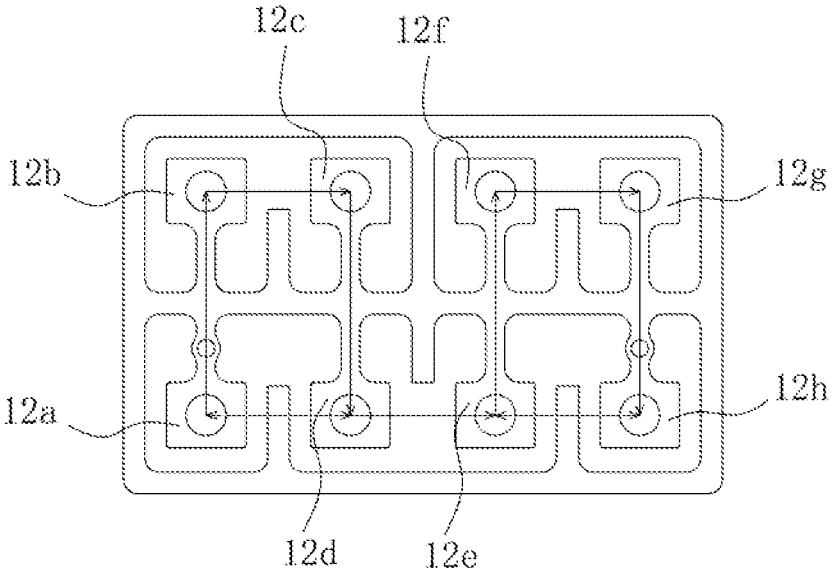
FIG. 19 is a structural diagram of a resonant structure of the alternative the cross-coupled filter according to Embodiment 5 of the present disclosure.

In addition, according to the space requirements of the filter, the structural requirements of the filter may be narrow and long. In the above embodiments 4-6, the signal input port and the signal output port are relatively close to each other. According to actual needs, when the signal input ports and the signal output port are zoomed out, the following modified structure can be used, for example, the above-mentioned embodiment 4 can be changed to the structure shown in FIG. 13 and FIG. 14, that is, as shown in FIG. 14, the 6 resonators in the frame are arranged in 3 columns, wherein 2 resonators are arranged in each column, and 6 resonators are arranged in the frame according to the S-shaped signal transmission path. As another example, the above-mentioned embodiment 6 can be changed to the structure shown in FIG. 23 and FIG. 24 or FIG. 25 and FIG. 26, that is, the 8 resonators in the frame are arranged in 4 columns, and 2 resonators are arranged in each column, and the 8 resonators in the frame are arranged according to a plurality of continuous U-shaped or S-shaped signal transmission paths. As another example, the above-mentioned embodiment 5 can be changed to the structure shown in FIG. 18 and FIG. 19.

In addition to the fourth order, sixth order, eighth order filters described in the foregoing embodiments 1 to 6, the present disclosure is also applicable to any other filters with no less than four resonators.

The technical content and technical features of the present disclosure have been disclosed as above, but those skilled in the art may still make various substitutions and modifications based on the teaching and disclosure of the present disclosure without departing from the spirit of the present disclosure. Therefore, the protection scope of the present disclosure should not be limited in the content disclosed in the embodiments, but should include various substitutions and modifications that do not deviate from the present disclosure, and are covered by the claims of this patent application.

What is claimed is:

1. A cross-coupled filter, wherein:

the cross-coupled filter comprises a resonant structure including a plurality of columns of resonant units, each column of resonant units including at least two resonators;

a dominant coupling mode of a coupling between two adjacent resonators in a same column is electrical coupling or magnetic coupling;

dominant coupling modes of a plurality of groups of two adjacent resonators in the same column alternate between electrical coupling and magnetic coupling;

a dominant coupling mode of a coupling between two adjacent resonators in adjacent columns is electrical coupling or magnetic coupling;

dominant coupling modes of a plurality of groups of two resonators of two adjacent columns alternate between electrical coupling and magnetic coupling, to form at least a set of cross-coupling.

2. The cross-coupled filter according to claim 1, wherein the resonant structure is integrally formed, the resonant structure further comprises a frame, and the resonant units are integrally formed on the frame.

3. The cross-coupled filter according to claim 1, wherein each of the resonators has an overall cylindrical appearance, and comprises a resonant head and a resonant tail opposite to each other, and a width of the resonant head is greater than a width of the resonant tail.

4. The cross-coupled filter according to claim 3, wherein the filter further comprises a cover arranged on the resonators, and the cover comprises a top cover arranged on an upper end of the resonant structure and a bottom cover arranged on a lower end of the resonant structure to form a closed filter cavity.

5. The cross-coupled filter according to claim 4, wherein the top cover comprises a plurality of protrusions and at least a shielding post, wherein, each protrusion is formed by extending from an end face of the top cover close to the resonant structure toward the resonant structure, and a position of the protrusion on the top cover corresponds to a position of the resonant head of the resonator on the resonant structure; and the shielding post is located between two adjacent resonators.

6. The cross-coupled filter according to claim 4, wherein the bottom cover comprises a plurality of protrusions and at least a shielding post, wherein, each protrusion is formed by extending from an end face of the bottom cover close to the resonant structure toward the resonant structure, and a position of the protrusion on the bottom cover corresponds to a position of the resonant head of the resonator on the resonant structure; and the shielding post is located between two adjacent resonators.

7. The cross-coupled filter according to claim 3, wherein the resonant tails of two adjacent resonators in the same column are connected to form the dominant coupling mode of magnetic coupling, or the resonant heads are placed face-to-face to form the dominant coupling mode of electrical coupling, and distributed positions of the plurality of groups of adjacent resonators in the same column alternate between face-to-face of the resonant heads and connection of the resonant tails.

8. The cross-coupled filter according to claim 1, wherein at least one partition wall is disposed between two adjacent columns of the resonant units and configured to adjust the dominant coupling mode between two adjacent resonators of the two adjacent columns of the resonant units to electrical coupling or magnetic coupling.

9. The cross-coupled filter according to claim 1, further comprising:

at least one structural member configured to enhance an amount of cross-coupling between the resonators, and each structural member connects two resonators that are cross-coupled.

10. The cross-coupled filter according to claim 4, wherein the cover further comprises a plurality of tuning screws and a plurality of coupling adjustment screws, the resonant head is provided with a tuning hole, and each tuning screw passes through the cover and extends into the tuning hole of the corresponding resonant head to adjust a resonant frequency of the corresponding resonator; each coupling adjustment screw passes through the cover and extends to a position between two adjacent resonators to adjust an amount of coupling between the corresponding two adjacent resonators.

11. The cross-coupled filter according to claim 1, wherein the plurality of columns of resonant units are distributed along a signal transmission path, and the signal transmission path is U-shaped, S-shaped, or a curve path formed by a plurality of continuous U-shapes or continuous S-shapes.

* * * * *